US009644249B2

(12) United States Patent
Haidar

(10) Patent No.: US 9,644,249 B2
(45) Date of Patent: May 9, 2017

(54) PRODUCTION OF ALUMINIUM-SCANDIUM ALLOYS

(71) Applicant: Commonwealth Scientific and Industrial Research Organisation, Campbell, Australian Capital Territory (AU)

(72) Inventor: Jawad Haidar, Lindfield (AU)

(73) Assignee: THE COMMONWEALTH OF AUSTRALIA COMMONWEALTH SCIENTIFIC AND INDUSTRIAL RESEARCH ORGANISATION, Campbell (AU)

( * ) Notice: Subject to any disclaimer, the term of this patent is extended or adjusted under 35 U.S.C. 154(b) by 94 days.

(21) Appl. No.: 14/647,054

(22) PCT Filed: Mar. 14, 2014

(86) PCT No.: PCT/AU2014/000273

§ 371 (c)(1),
(2) Date: May 22, 2015

(87) PCT Pub. No.: WO2014/138813

PCT Pub. Date: Sep. 18, 2014

(65) Prior Publication Data

US 2015/0275332 A1 Oct. 1, 2015

(30) Foreign Application Priority Data

Mar. 15, 2013 (AU) ..... 2013201572

(51) Int. Cl.

| | |
|---|---|
| ***B22F 9/20*** | (2006.01) |
| ***C22B 21/02*** | (2006.01) |
| ***C22C 1/04*** | (2006.01) |
| ***C22C 1/02*** | (2006.01) |
| ***C22C 21/00*** | (2006.01) |
| ***B22F 9/22*** | (2006.01) |
| ***C22B 5/04*** | (2006.01) |
| ***C22B 21/00*** | (2006.01) |

(52) U.S. Cl.

CPC ..... *C22C 1/0416* (2013.01); *B22F 9/20* (2013.01); *B22F 9/22* (2013.01); *C22B 5/04* (2013.01); *C22B 21/0046* (2013.01); *C22B 21/02* (2013.01); *C22C 1/02* (2013.01); *C22C 21/00* (2013.01)

(58) Field of Classification Search

None

See application file for complete search history.

(56) References Cited

U.S. PATENT DOCUMENTS 5,037,608 A * 8/1991 Tarcy ..... C22B 5/04 420/405
5,409,518 A * 4/1995 Saito ..... C22C 32/0073 419/12

(Continued)

*Primary Examiner* — George Wyszomierski

(74) *Attorney, Agent, or Firm* — John P. White; Cooper & Dunham LLP

(57) ABSTRACT

A process for producing an aluminum-scandium based alloy from aluminum and scandium chloride, the process also producing aluminum chloride as a by-product and including the step of reducing scandium chloride in the presence of aluminum in a reaction zone and under reaction conditions which favor production of the aluminum-scandium based alloy.

22 Claims, 8 Drawing Sheets

(56) References Cited

U.S. PATENT DOCUMENTS

| | | | | |
|---|---|---|---|---|
| 6,045,631 | A * | 4/2000 | Tarcy | C22C 1/03 148/551 |
| 6,689,191 | B2 * | 2/2004 | Dunmead | B01J 8/087 75/336 |
| 6,849,104 | B2 * | 2/2005 | Shekhter | H01G 9/04 423/592.1 |
| 2015/0232965 | A1 * | 8/2015 | Sugita | C22C 1/026 75/685 |

* cited by examiner

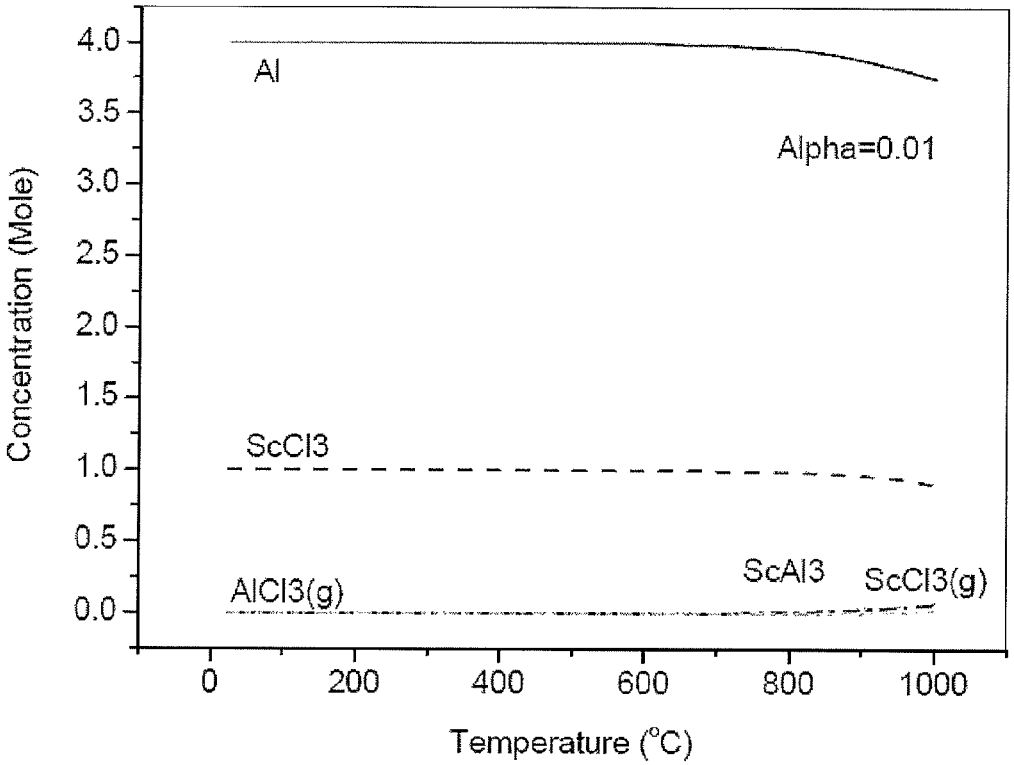
Figure 3-a
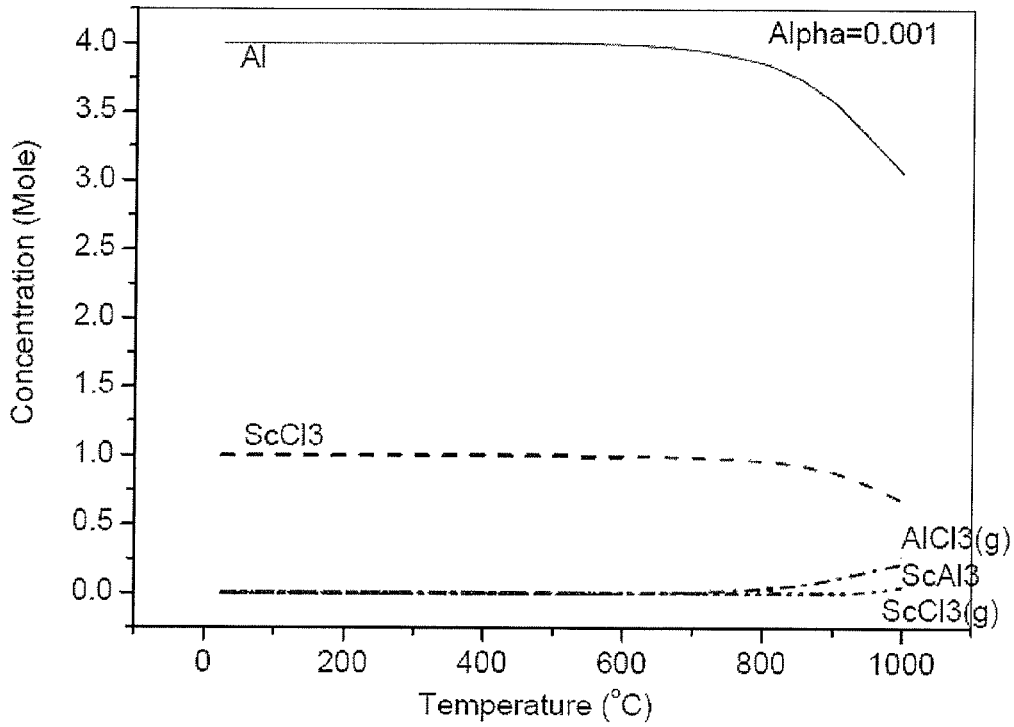
Figure 3-b

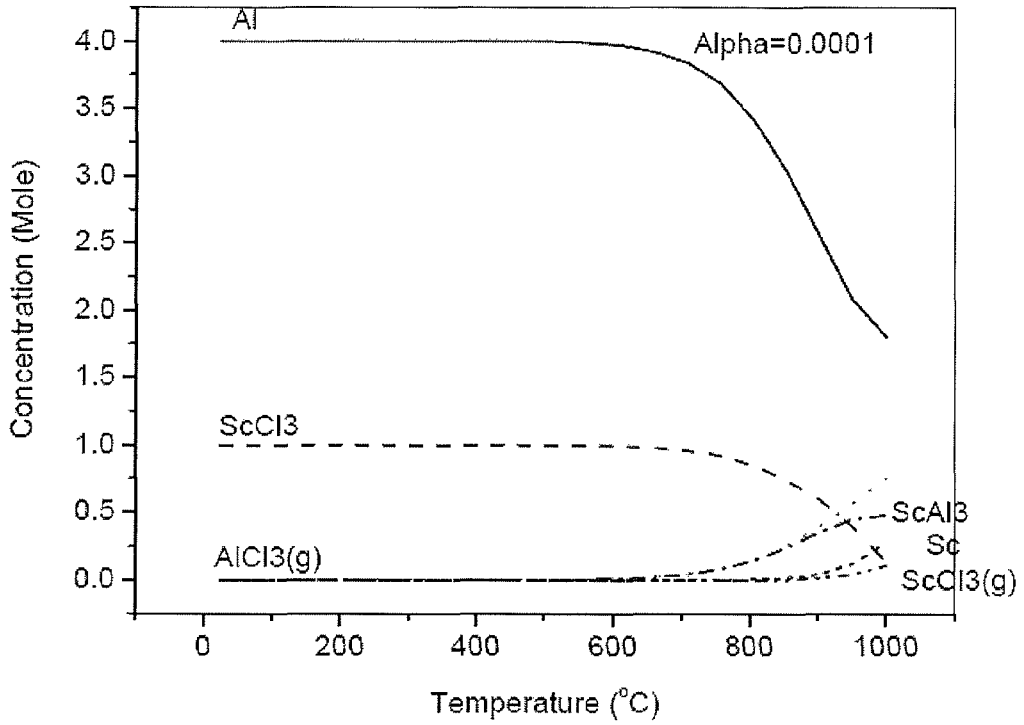
Figure 3-c
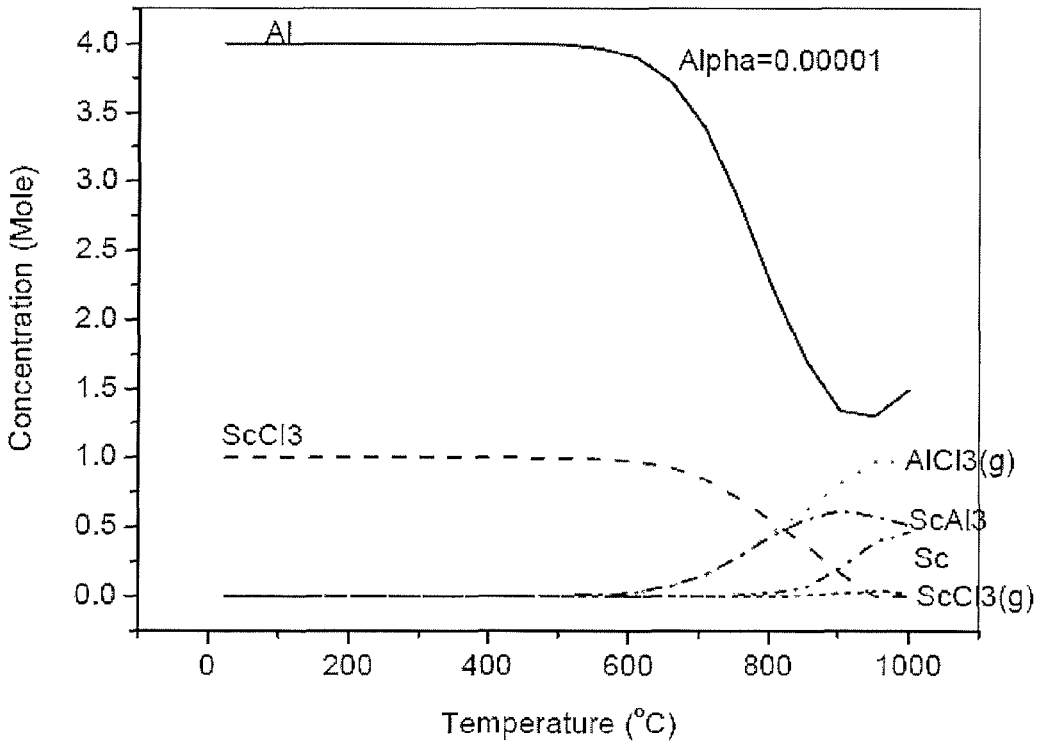
Figure 3-d

PRODUCTION OF ALUMINIUM-SCANDIUM ALLOYS

CROSS-REFERENCE TO RELATED APPLICATIONS

This application is a §371 national stage of PCT International Application No. PCT/AU2014/000273, filed Mar. 14, 2014, claiming priority of Australian Patent Application No. 2013201572, filed Mar. 15, 2013, the contents of each of which are hereby incorporated by reference in their entirety.

TECHNICAL FIELD

The present invention relates broadly to a process for producing aluminium-scandium based alloys from aluminium and scandium chloride.

BACKGROUND

The main application of scandium (Sc) metal is as a minor alloying additive in a number of aluminium (Al) alloys which are used in aerospace components and luxury and high performance sports equipment. Despite the high of cost of scandium, its field of application in Al alloys is gaining increasing interest due to the attractive characteristics it induces when added to these alloys. The use of Al—Sc alloys is of particular interest in the aerospace industry because the addition of Sc improves the weldability of the Al alloy. This may enable such alloys when used as skin components in aerospace applications to be joined by welding rather than the more expensive riveting techniques that are currently employed. However, expanding the current limited market of Al—Sc alloys depends on reducing the cost of scandium and establishing secure and reliable production and processing routes.

Al—Sc alloys have fine $Al_3Sc$ precipitates that are coherent with the Al matrix. The $Al_3Sc$ precipitates tend to affect several of the alloy's characteristics, including strength, weldability and recrystallization behaviour. There are three main effects that can be obtained by adding Sc to Al alloys: (i) grain refinement in heat affected areas during casting or welding, (ii) precipitation hardening from $Al_3Sc$ particles and (iii) grain structure control from $Al_3Sc$ dispersoids. Addition of Sc to Al improves its weldability by reducing recrystallization and limiting excessive grain-growth in heat affected weld zones. Also, the presence of fine dispersions of $Al_3Sc$ has been shown to increase both the strength and the creep resistance of coarse-grained binary Al alloys in addition to providing excellent fatigue properties with the resulting alloys amenable to be cold forged, hot forged or cast using vacuum die casting.

Addition of some other metals in combination with Sc can amplify the advantageous effects of Sc on Al alloys; for example, it is known that the use of zirconium-scandium additives is particularly effective, due to the shell structure of the $Al_3(Sc,Zr)$ dispersoids. Zirconium (Zr) is known to increase both the strength and the recrystallization resistance of Al—Sc alloys by substitution of Sc for Zr to form $Al_3(Sc_{(1-x)}Zr_x)$ precipitates with decreased coarsening kinetics in comparison to $Al_3Sc$. Simultaneous addition of Sc and Zr has been shown to synergistically promote much higher strengths than either Sc or Zr additions produce alone. However, current techniques for the production of Al—Sc alloys have faced a number of difficulties. Alloying Sc metal directly with aluminium melt is slow and can require extended times to dissolve the bulk Sc metal or Sc master alloy lumps unless the melt is heated to more than 1150° C. Furthermore, this method requires the additional cost of producing high purity Sc metal. The most common scandium purification processes starts by producing scandium halides (e.g. scandium chlorides) which are then converted to oxides and then to the metal.

Another method of adding Sc to Al involves reducing high purity scandium oxide directly in the Al melt to produce an Al—Sc ingot.

It would be desirable to have a low cost process for production of Al—Sc based alloys and master alloys preferably in a powder form. Such a process would be particularly useful if it enables formation of compounds that cannot be obtained using current melt routes where the constituting elements are not chemically compatible.

SUMMARY OF THE INVENTION

According to one aspect: of the present invention there is provided a process for producing an aluminium-scandium based alloy from aluminium and scandium chloride, and including the step of reducing scandium chloride particulates in the presence of aluminium particulates through direct solid-solid reactions in a reaction zone and under reaction conditions which favour production of the aluminium-scandium based alloy, thereby producing aluminium-scandium based alley particulates, and aluminium chloride as a by product.

In some embodiments, the reaction conditions which favour production of the aluminium-scandium based alloy comprise removal of at least some of the aluminium chloride from the reaction zone as it is produced.

In some embodiments, the reaction conditions favouring the production of the aluminium-scandium based alloy comprise diluting the aluminium chloride in the reaction zone.

In one form, the process comprises heating a mixture of scandium chloride and aluminium at temperatures of up to 1000° C. and removing at least some of the aluminium chloride from the reaction zone. In one form, removal of the aluminium chloride involves maintaining a reduced partial pressure for aluminium chloride in the reaction zone.

The reduction reaction may also be favoured by diluting the aluminium chloride in the reaction zone. In one form, diluting the aluminium chloride involves maintaining a reduced partial pressure for aluminium chloride in the reaction zone.

In other embodiments, the aluminium chloride may be removed and/or diluted in the reaction zone by flowing a gas, preferably an inert gas, through the reaction zone.

The Al may be provided to the reaction zone either as aluminium metal or as an aluminium alloy or compound.

The amount of Al used with the scandium chloride in the process depends on the required Al—Sc alloy that is to be produced and in one preferred form corresponds to the stoichiometric amount required to reduce all of the reducible materials fed to the reaction zone (including the scandium chloride and any other reducible alloying additives) to their elemental base metal state plus the required concentration of Al in the Al—Sc alloy that is to be produced.

In another form, the amount of Al used with the scandium chloride in the process corresponds to between 100 atomic (at) % and 10000 at % of the amount of Al required to reduce all of the reducible materials fed to the reaction zone to their elemental base metal state.

In some embodiments, the reaction conditions comprise a minimum temperature of 160° C., preferably 200° C.

In some embodiments, the reaction conditions comprise at least a section of the reaction zone having a temperature of at least 600° C., preferably of at least 700° C.

In some embodiments, the reaction conditions comprise a maximum temperature of between 600° C. and 1000° C.

In some embodiments, the process also comprises preheating the reactants, which comprise the scandium chloride and the aluminium and optionally other alloying additives, prior to the reducing step, such as to at least 160° C.

In some embodiments, the reactants are preheated to a temperature less than the minimum temperature in the reaction zone.

In some embodiments, the reaction zone has a first section in which the reaction conditions comprise a temperature of 600-900° C. and a second section in which the reaction conditions comprise a temperature of 600-1000° C.

In some embodiments, the second section is at a higher temperature than the first section.

In some embodiments, the reaction conditions comprise a pressure of below 1 bar, preferably below 200 mbar, preferably below 100 mbar, preferably below 10 mbar, more preferably around 0.01 mbar.

In some embodiments, the reaction conditions comprise a partial pressure of aluminum chloride below 500 mbar, preferably below 200 mbar, preferably below 100 mbar, preferably below 10 mbar, more preferably around 0.01 mbar.

In some embodiments, the process comprises applying the reaction condition pressure to the reaction zone using a suction or vacuum pump.

In some embodiments, the scandium chloride and the aluminium are provided to the reaction zone as solid particles.

In some embodiments, the scandium chloride and the aluminium are provided with a mean particle size in one dimension of less than 50 micron.

In some embodiments, the process comprises preparing a mixture of scandium chloride and aluminium, prior to feeding the mixture to the reaction zone.

In some embodiments, the mixture is prepared by mixing the or close to the stoichiometric amounts of scandium chloride and aluminium required to produce the aluminium-scandium based alloy.

In some embodiments, the process comprises milling the scandium chloride and/or aluminium to a mean particle size in one dimension of less than 50 micron.

In some embodiments, the scandium chloride and the aluminium are milled together.

In some embodiments, the scandium chloride and/or the aluminium are milled in the presence of aluminium chloride.

In some embodiments, the aluminium-scandium based alloys are produced as solid particles.

In some embodiments, the process comprises moving solids through the reaction zone in a first direction and moving gases through the reaction zone in a second direction.

In some embodiments, the second direction is opposite to the first direction.

In some embodiments, the process comprises adding other alloying elements for the aluminium-scandium based alloy to the reaction zone.

In some embodiments, other alloying additives, including any metallic, semi metallic or non-metallic element from the periodic table may be added to the scandium chloride and aluminium prior to the reduction step to provide the other alloying elements. The concentration of individual other alloying elements in the Al—Sc based alloy is preferably less than a few wt %.

In some embodiments, one or more of the other alloying elements are provided to the reaction zone as an alloy with the aluminium and/or as part of a compound with the aluminium.

In some embodiments, the process comprises reacting and/or alloying the aluminium with one or more of the other alloying elements prior to mixing it with the scandium chloride.

In some embodiments, the other alloying elements may comprise any one or more of zirconium, silicon, boron or copper.

In some embodiments, the reaction zone is located in a reactor, the reactor having a reactant inlet, a product outlet and a gas outlet, the process comprising feeding the scandium-chloride and aluminium to the reactor through the reactant inlet and outputting the aluminium-scandium based alloy from the reactor through the product outlet.

In some embodiments, the reaction conditions comprise a pressure gradient across the reactor from a first end of the reactor to a second end of the reactor, the reactant inlet and the gas outlet located towards the first end and the product outlet located towards the second end.

In some embodiments, the pressure gradient is applied whereby the pressure in the reactor at the first end is lower than at the second end.

In some embodiments, the reaction conditions comprise a temperature gradient across the reactor from a first end of the reactor to a second end of the reactor, the reactant inlet and the gas outlet located towards the first end and the product outlet located towards the second end.

In some embodiments, the temperature gradient is applied whereby the temperature in the reactor at the first end is lower than at the second end.

In some embodiments, the reactor has a gas inlet and the process comprises inputting an inert gas into the reactor through the gas inlet.

In some embodiments, the process comprises flowing an inert gas through the reaction zone.

In some embodiments, the process comprises collecting any solids that exit the reactor through the gas outlet and returning the collected solids to the reactor.

In some embodiments, the process comprises mixing the solids as they move through the reactor.

In some embodiments, the process also comprising removing any material that has accreted on the walls of the reactor.

In some embodiments, the reactor is in the form of a batch reactor, or a continuous reactor that incorporates an auger, a screw feeder, a plough mixer or a rotary kiln.

According to yet another aspect of the present invention there is provided an apparatus for the production of an aluminium-scandium based alloy using the process described in the above embodiments, the apparatus comprising a reactor having a reaction zone which is suitable for reducing scandium chloride in the presence of aluminium under reaction conditions which favour production of the aluminium-scandium based alloy.

The reactor may be a batch reactor or a continuous reactor.

In some forms, the reactor comprises a reaction vessel capable of operating with metal powder, halides, nitrides and oxides at temperatures up to 1100° C. and pressures between 1 bar and 0.01 mbar.

The reaction vessel may include a number of discrete heating sections for carrying out different reactions.

In some embodiments, the apparatus comprises a mechanism arranged for mixing solids within the reactor.

The reactor may be in the form of an auger, a screw feeder, a plough mixer or a rotary kiln In some embodiments, the apparatus comprises a collector for collecting any solids escaping from the reactor and return the collected solids to the reaction zone.

In some embodiments, the apparatus comprises a condenser for collecting and condensing any aluminium chloride that leaves the reactor.

In some embodiments, the apparatus comprises a pressure control unit operable to maintain an atmosphere within the reactor between 1 bar and 0.01 mbar.

Usually, the apparatus also comprises an appropriate arrangement for heating the reactants and is suitable for implementing the method of any of the foregoing or following embodiments.

In some embodiments, the apparatus comprises one or more storage containers for holding solid reactants (eg. scandium chloride and Al) under an inert atmosphere, preferably in particulate form. In these embodiments, the apparatus may also comprise one or more particle feeders for feeding solid reactants from at least one of the storage containers to the reactor.

In some embodiments, the reactor is provided with one or more gas inlets for the introduction of reactive gases and/or inert gases.

Hereinafter, the term "aluminium chloride" is used to describe any Al—Cl compounds including $Al_2Cl_6$, $AlCl_3$, $AlCl_2$, and AlCl, and the term "aluminium-scandium based alloy(s)" or "Al—Sc based alloy(s)" is used to describe any alloys or intermetallic compounds containing Al and Sc, where the Al is present at levels between 1 weight (wt) % and 99 wt %.

BRIEF DESCRIPTION OF THE DRAWINGS

Features and advantages of the present invention will become apparent from the following description of embodiments thereof, by way of example only, with reference to the accompanying drawings, in which:

FIG. 3 is graphs of the calculated composition of a mixture of $ScCl_3$—Al (molar ratio of 1:4) after being heated to temperatures of up to 1000° C. with different partial pressure of AlCl3(g); FIG. 3-*a* is for when the partial pressure of $AlCl_3(g)$ is reduced by a factor of 100; FIG. 3-*b* is for when the partial pressure of $AlCl_3(g)$ is reduced by a factor of 1000; FIG. 3-*c* is for when the partial pressure of $AlCl_3(g)$ is reduced by a factor of $10^4$; and FIG. 3-*d* is for when the partial pressure of $AlCl_3(g)$ is reduced by a factor of $10^5$.

DESCRIPTION OF EMBODIMENTS

The present invention in a preferred embodiment provides a route for forming high quality alloy powders based on Al—Sc starting from low-cost materials without going through the usual powder production steps of melting and atomising. The process disclosed herein simplifies current techniques for production of Al—Sc master alloys with a significant reduction in the required processing steps and significant improvements in the quality and characteristics of the Al—Sc end product. Also, the process overcomes problems associated with conventional melting routes such as segregation and allows for the inclusion of a large number of other alloying additives at levels that may not be obtained through the melt route and with end-product compositions that may otherwise have not been possible to produce in commercial quantities.

The process disclosed herein will be illustrated assuming a simple stoichiometric reduction reaction leading to an alloy with the composition Al—Sc:

$$ScCl_3+(x+1)Al \leftrightarrow SC—Al_x+AlCl_3(g)+\Delta G \quad (1)$$

$AlCl_3(g)$ is gaseous aluminium chloride and ΔG is the Gibbs free energy of the reaction.

Figure 1:
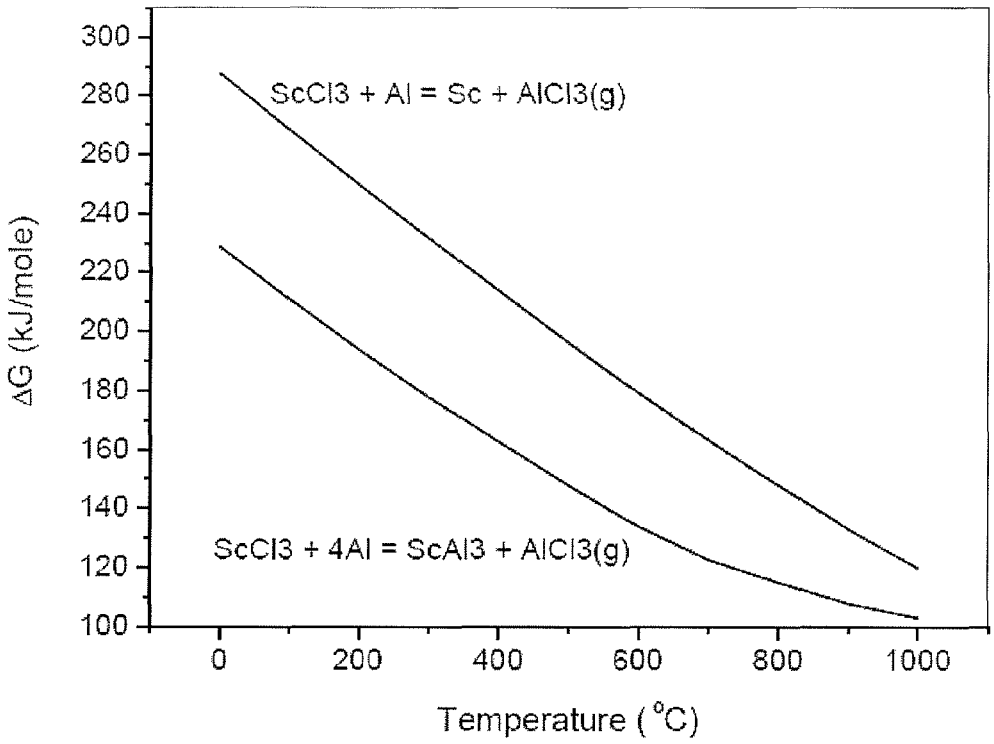
FIG. 1 is a graph of the calculated Gibbs free energy (ΔG) for the equilibrium reaction $ScCl_3+(x+1)Al \leftrightarrow Sc—Al_x+AlCl_3(g)+\Delta G$ where the products are Sc (x=0) or $Al_3Sc$ (x=3).

FIG. 1 shows variation of the Gibbs free energy for Reaction 1 corresponding to the production of pure Sc (x=0) and ScAl3 (x=3) at temperatures up to 1000° C. It can be seen there that ΔG is positive at all temperatures below 1000° C. This indicates that the reaction in the forward direction is highly endothermic and ordinarily would make the forward reaction unfavourable for producing Al—Sc alloys.

Figure 2:
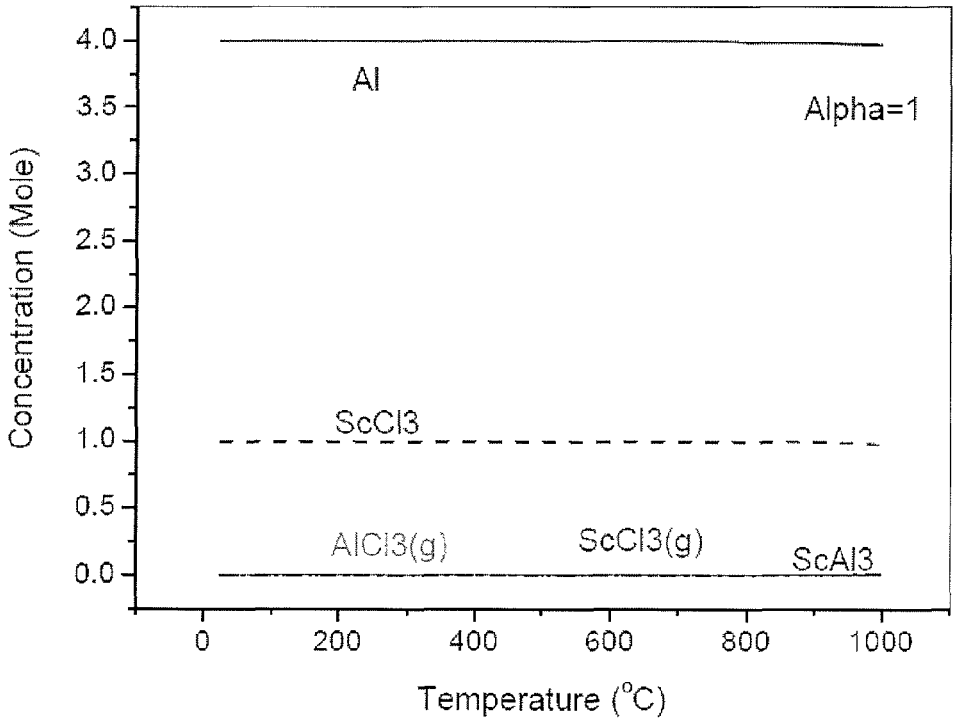
FIG. 2 is a graph of the calculated equilibrium composition of a mixture of $ScCl_3$—Al (molar ratio of 1:4) at temperatures up to 1000° C.

This result is further illustrated in FIG. 2 which shows the composition of a mixture of $4Al\text{-}1ScCl_3$ mixture at temperatures up to 1000° C. It can be seen in FIG. 2 that scandium chloride remains stable with no significant reaction with Al at any temperatures up to 1000° C. This suggests that under normal equilibrium conditions Al reduction of $ScCl_3$ is unfavourable for the production of Al—Sc alloys and compounds.

However, according to one aspect of the present invention by using suitable reaction conditions, the forward direction of Reaction 1 can be favoured, leading to formation of a product in the form of an alloy powder based on Al—Sc and a by-product of aluminium chlorides.

In one embodiment this can be achieved if the partial pressure of $AlCl_3(g)$ in the reaction zone was reduced below a certain threshold. Reducing the partial pressure of $AlCl_3(g)$ reduces reverse reactions to scandium chlorides and maximises the forward direction leading to Al—Sc. In particular embodiments, reducing the partial pressure of aluminium chlorides by a factor of more than 1000 at reaction temperatures higher than 600° C. results in significant increases in the net reaction rate in the forward direction of Reaction 1.

FIG. 3 shows the calculated composition of a mixture of 4Al-1 ScCl3 after being heated to temperatures of up to 1000° C. for various reductions in the partial pressure of aluminium chloride. In FIG. 3-*a*, the reduction factor is 100, increasing to 1000 in 3-*b* and then to $10^4$ in 3-*c* and $10^5$ in 3-*d*. FIG. 3-*a* shows that a 100 times reduction in the partial pressure of aluminium chloride induces only minor reaction in the forward direction and only at temperatures above 800° C., and improving only slightly as the reduction factor increases to 1000 in FIG. 3-*b*. For a $10^4$ reduction in the partial pressure, the forward reaction becomes very favourable at temperatures above 700° C. This threshold temperature reduces to 600° C. as the reduction factor increases to $10^5$ in FIG. 4-*d*.

The partial pressure of aluminum chloride in the reaction zone is preferably reduced below 500 mbar, preferably below 200 mbar, preferably below 100 mbar, preferably below 10 mbar, more preferably around 0.01 mbar.

The partial pressure of the aluminium chloride in the reaction zone can be reduced by removing at least some of the aluminium chloride gas and/or by diluting the concentration of the aluminium chloride in the reaction zone. This may involve, for example, flowing or streaming a gas (preferably an inert gas such as argon or helium) through the reaction zone including to drive aluminium chloride out of the reaction zone.

Reducing the partial pressure of aluminium chloride may also be achieved by reducing the total pressure in the reaction zone atmosphere, for example to a pressure of between 0.01 mbar and 1 bar. In some embodiments, the pressure in the reaction zone atmosphere may be reduced to between 100 mbar and 200 mbar or 10 mbar and 100 mbar or 1 mbar and 10 mbar or 0.01 and 1 mbar.

In one form, the process for producing an Al—Sc based alloy comprises the steps of:

- preparing a mixture of materials from a predetermined amount of precursor chemicals including scandium chloride and a predetermined amount of a reducing Al metal, alloy or compound and any other precursor materials;
- processing the said mixture at temperatures between 200° C. and 1000° C. to induce reactions between scandium chloride and Al leading to the formation of the Al—Sc alloy in powder form and aluminium chlorides, whilst maintaining a reduced partial pressure of aluminium chloride and rapidly removing at least some of the aluminium chloride from the reaction zone;
- collecting and recycling any solid materials that escape from the reaction zone; and,
- separating the resulting Al—Sc alloy powder from any residual unreacted material and carrying out post processing if required.

The scandium chloride ($ScCl_3$) is in the form of finely divided particles with a mean particle size of less than 200 microns. The reduction of $ScCl_3$ with Al is carried out through direct solid-solid reactions under a reduced pressure atmosphere and at temperatures between 200° C. and a maximum temperature below 1000° C.

At pressures below 200 mbar, reactions between $ScCl_3$ and Al occur at temperatures higher than 600° C., and in a preferred embodiment, processing is carried out by heating the reactants to temperatures from 600° C. to 800° C. to obtain gradual reduction of the chlorides and avoid blowing the powder out of the reaction zone by the high velocity of the gaseous byproducts resulting from the reaction. Preferably, the materials are processed at temperatures below the melting point of Al for a certain residence time to produce Al—Sc compounds with a melting temperature higher than the starting Al alloy. The maximum processing temperature depends on other alloying additives being processed based with Sc and Al and is preferably below 1000° C. and. By way of an illustrative example only, if the Al—Sc system alone was being used, then the maximum temperature would be no more than 900° C.

The reducing Al is a powder or flakes of substantially pure Al metal or an Al alloy. It is desirable to have a maximum contact surface area between the materials to be reduced in the reaction and the reducing agent. As such, it is desirable to have the reducing Al in a fine particulate form. In one embodiment, the reducing Al is in the form of a powder or flakes having a mean particle size in one dimension of less than 50 microns, but preferably less than 20 microns, more preferably less than 15 microns and still more preferably less than 10 microns.

The Al and scandium chloride may be milled (together or separately) to reduce their respective particle sizes, to a mean particle size of less than 20 microns and more preferably to less than 15 microns and still more preferably to less than 10 microns in at least one dimension. This milling step can include milling the Al and the scandium chloride with one or more other alloying additives to produce a mixture of fine particulates of Al—$ScCl_3$-alloying additives. Milling the Al and the scandium chloride may be carried out in the presence of a surfactant (to improve the efficiency of the milling process). A particularly suitable surfactant is aluminium chloride as it is a byproduct from the reduction process and therefore can be sourced from the reaction and dealt with in the reactor.

If an Al alloy is used as the reductant, its composition depends on the required Al—Sc alloy end product. The starting amount of the reducing Al (whether added as an alloy or as a pure metal) depends on the starting materials (ie. the Scandium chloride and other alloying additives) and the required composition of the Al—Sc end products. For end products with a low Al content, the starting amount of Al is preferably around the stoichiometric amount needed to reduce all the reducible starting materials. If a larger amount of Al in the end product is required, then the amount of starting Al can be from 100 at % and up to 1000 at % of the stoichiometric amount. Also, the relationship between the relative composition of the starting materials and the composition of the end product depends on losses within the system and is purely experimental. Normally, the relationship is very close to stoichiometric but there can be minor losses due to powder carry over by the gas stream. This loss depends on a number of factors, including the reactant morphology and particle size, the reactor geometry and the operating conditions. If losses were large enough to cause significant deviation from the stoichiometric target composition, then calibration of the process and the production apparatus would be required to determine the amount of loss and compensate for it in the starting composition; however, losses are usually small.

For solid-solid reactions, obtaining a stoichiometric yield requires mixing the reactants at an atomic level to obtain an optimum contact surface area in addition to the possible need of a long reaction time to bring the reaction to full yield. Under practical conditions, the reactants have a finite particle size and the contact surface area is limited and so is the reaction time. The process produces higher yields when the required product has a high Al content, for which the starting molar ratio for Al to $ScCl_3$ is large.

As a way of introducing other required alloying additives to the process, the process can comprise the step of pre-treating the starting Al with a reactive gas to form an Al compound before the Al is used in the reduction reaction with scandium chloride. For example, if silicon is required as an alloying additive, the process can include the step of reacting the starting Al with silicon chloride prior to carrying out the reduction reaction.

This pre-treatment of Al by reacting it with other compounds may occur during milling. For example, if zirconium is required as an alloying additive, then the method can include the step of milling the reducing Al alloy with zirconium powder or other zirconium materials. The resulting Al-based alloy or compound is then used as a reducing agent in the process.

Other alloying additives can also be mixed with the scandium chloride and Al reactants prior to or in the reactor. In some embodiments, they can also be reacted with the Al—Sc alloy produced at the end of the reduction step. The other alloying additives may also be introduced through mixing or milling with the scandium chloride, and then the resulting fully or partially reducible mixture is reduced with the Al in the reduction reaction. Particular care is required to be exercised when processing a high concentration of other alloying additives or when there is a large amount of reducible material in the reactant material being fed to the reactor. Reactions between many materials and Al can be highly exothermic which can lead to explosive reactions. For exothermic reactions between Al and the other alloying additives, if a large amount of other alloying additives is used, heat generated by the reaction can lead to melting of the reducing Al alloy and formation of uncontrollable phases of aluminides which in turn can stifle the desired reactions to produce Al—Sc alloys. Accordingly, in a preferred embodiment, the amount of other alloying additives used is constrained such that the concentration of individual other alloying elements in the Al—Sc alloy end product is small, and is preferably below 5 wt %.

The other alloying additives may be a compound or a mixture of compounds or elements based on one or more elements from the periodic table, but in particular may be Boron (B), Copper (Cu), Silicon (Si) and Zirconium (Zr). The alloying additives can be in the form of halides, oxides, nitrides, pure elements and intermetallic compounds, and be in gas, liquid or solid phase.

The high velocity gaseous aluminium chloride that is produced in the reaction zone can blow a significant amount of solid material out of the reaction zone. Accordingly, the process also comprises collecting solid material escaping the reaction zone and returning them to the reaction zone.

A certain amount of the reducible material (ie. the scandium chloride and other reducible alloying additives) entering the reaction zone can evaporate or sublime and then recondense in other parts of the reactor at lower temperatures or escape the reactor with the gases that are flowing through the reactor. Accordingly, in some embodiments, the process includes the step of collecting gaseous reducible material and returning them to the reaction zone, preferably after first condensing the reducible material.

The product of the process is a powder composed of a metal alloy based on Al—Sc with other alloying elements that can include any non inert element from the periodic table.

The process can also comprise separating the Al—Sc based alloy end products from any residual un-reacted material. The process can also comprise the step of washing and drying the Al—Sc based alloy that is produced.

Figure 4:
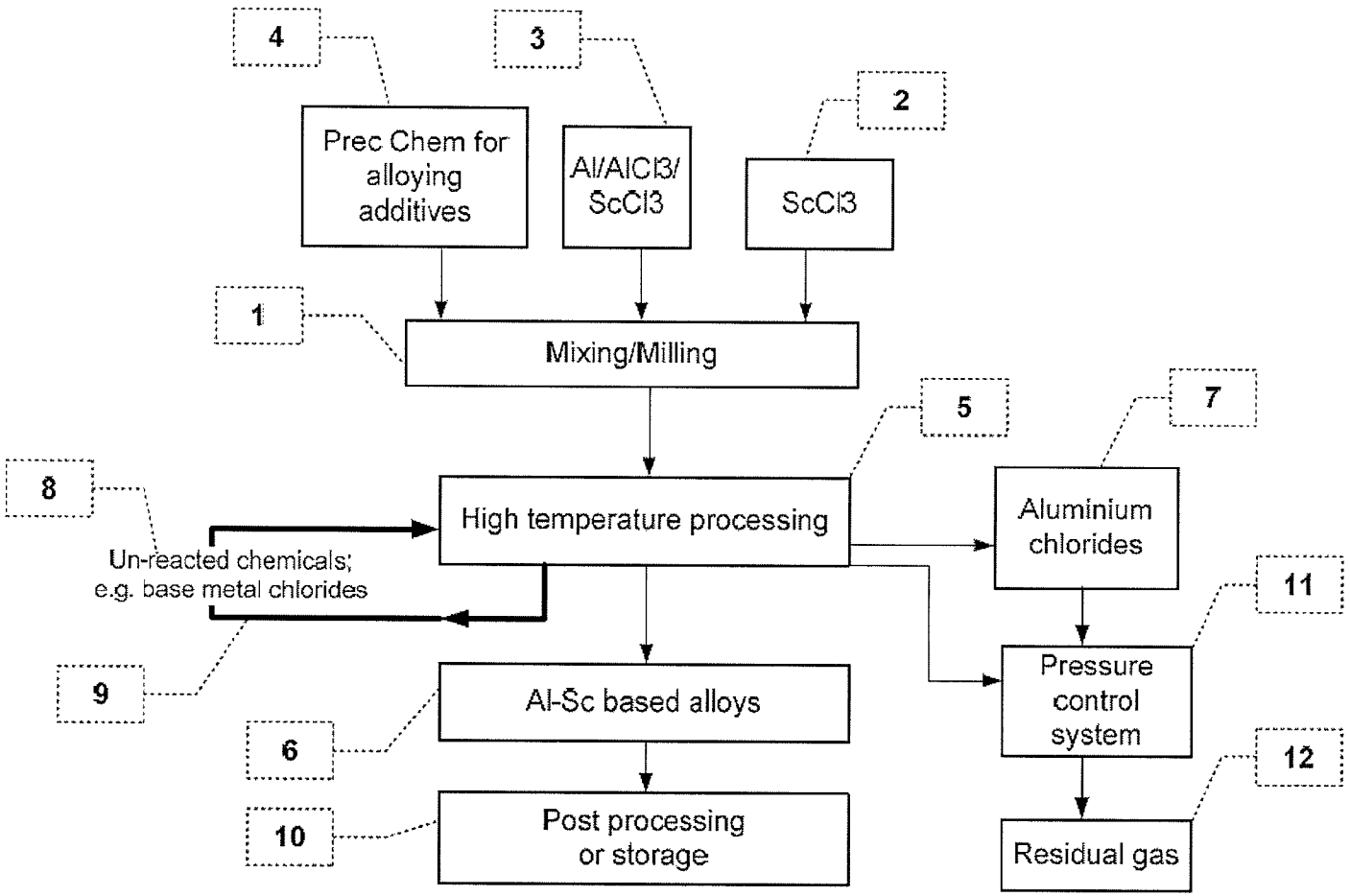
FIG. 4 is a block diagram illustrating the steps of a process for producing Al—Sc based alloys according to an embodiment of the present invention.

Referring now to FIG. 4, a schematic representation of the process according to one embodiment of the present invention is shown.

In a first step 1, the reactants scandium chloride ($ScCl_3$) 2 and Al 3 are milled together to reduce the Al particles to a mean size in one dimension of less than 50 microns and preferably also to reduce the size of the $ScCl_3$ particles to 50 micron. As described above, this provides a high contact surface area between $ScCl_3$ and Al for the reduction reaction. The milling step can involve use of $AlCl_3$ surfactant although other surfactants may be used. In addition, precursor materials for other alloying additives 4 may also be added and milled with the Al—$ScCl_3$ mixture if required in the final Al—Sc alloy product at the end of the process. Although, as described earlier, the other alloying additives may be introduced at other steps in the process.

The mixture is heated in a reaction zone at temperatures between 200° C. and 1000° C. 5 under reaction conditions favourable to induce reactions between the reducible material in particular the $ScCl_3$ and the reducing Al that lead to formation the of an alloy powder based on Al—Sc 6 and a by-product, aluminium chloride 7.

Formation of the Al—Sc based alloy proceeds through condensation of the product from the Reaction 1 forward reaction on solid particulates in the reaction zone and then small particulates of sub-micron dimensions are formed. This is followed by sintering and agglomeration of the sub-micron particulates leading to products with a large particle size. Reaction 1 is heterogeneous under all conditions and can only proceed in the forward direction if it is catalysed by a solid surface(s) to act as condensation host for the reaction product.

As discussed before, the high velocity gaseous aluminium chloride emanating from the reaction zone tends to carry with it a significant amount of solid materials 8 away from the reaction zone and the process includes the step 9 of collecting any escaping solid materials and returning them to the reaction zone. At the end of the reduction reaction, the Al—Sc based alloy product is discharged for further processing 10, if required. The aluminium chloride by-product that is produced is collected in a dedicated vessel. Some of the aluminium chlorides may be recycled as surfactant through the milling step 1. Residual gases that have been stripped of aluminium chloride are passed through a scrubber to remove residual waste 12.

In the process outlined in FIG. 4, the reactants are processed at a temperature below or around the melting point of Al (to minimise Al melting) and then as the reaction progresses, the temperature is raised to help react any remaining un-reacted materials. By-products, in particular the aluminium chloride gas, are continuously removed from the reaction zone away from the solid reactants. All processing steps including mixing and preparation of the precursor materials are preferably carried out under an inert atmosphere and all high temperature processing steps are carried out under a reduced pressure or under vacuum generated by a pressure control system 11.

The process may be carried out in a continuous mode or a batch mode. A block diagram representation of a configuration for an apparatus 100 incorporating a batch reactor 101 for processing in batch mode is presented in FIG. 5 and for an apparatus 200 incorporating a continuous reactor 201 for operation in continuous mode is presented in FIG. 6.

The batch or continuous reactor 101, 201 may be made of any ceramic or metallic materials capable of withstanding processing temperatures up to 1100° C. and reduced pressure conditions of between 1 bar and 0.01 mbar without reacting with the reagents or the end products. For example, they may be made of a special high temperature grade of stainless steel suitable for operation with corrosive materials. Each reactor may be in the form of any suitable containment vessel that is also provided with a mechanism capable of providing intimate and efficient contact between the scandium chloride and other alloying additives and the reducing Al alloy. In particular, the reactor 101, 201 comprises a mechanism for moving and mixing particles such as a scraper, screw, lifters and/or rotation of the reactor vessel itself. The reactor 101, 201 may be in the form of an auger, a screw feeder, a plough mixer or a rotary kiln.

The batch and continuous reactors 101, 201 are also provided with appropriate heating arrangements for controlling the temperature in the reaction zones of the reactors including to provide different temperatures for different residence times according to the heat profile required to obtain maximum reaction yield.

Figure 5:
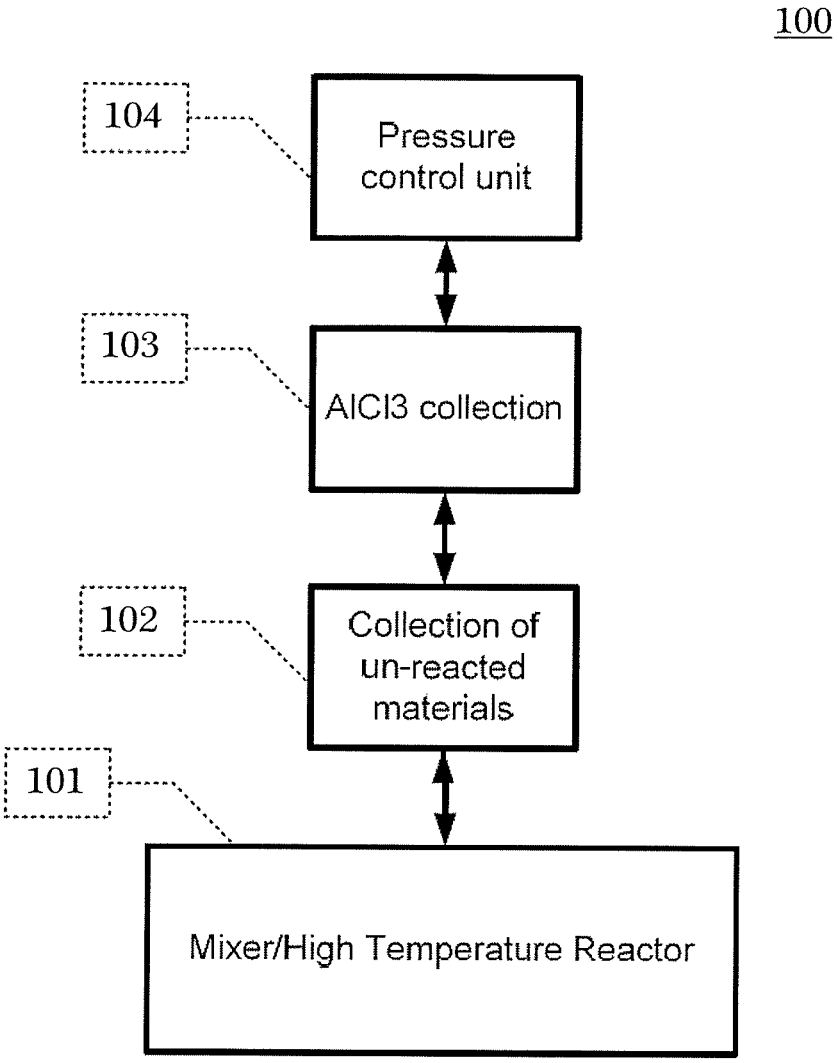
FIG. 5 is a block diagram of the configuration for an apparatus incorporating a batch reactor for carrying out a process for producing Al—Sc based alloys according to an embodiment of the present invention.

Referring specifically to FIG. 5, the batch reactor vessel 101 is linked to a collector vessel 102 where solid material escaping from reactor 101, are collected and returned to the reaction zone in the reactor vessel 101.

In one embodiment, the reactor 101 and the collector 102 can be two separate units. In another embodiment, they are sections of a single vessel. Preferably, both the reactor 101 and the collector are kept at a temperature higher than 160° C. and preferably higher than 200° C. to avoid condensation of reaction by-products, in particular aluminium chlorides. Reaction by-products, namely aluminium chlorides, are passed through a condenser 103, where they are cooled, condensed and collected in a dedicated vessel.

Each of the units in the apparatus 100; the reactor 101, the collector 102 and the condenser 103, operate under controlled pressure conditions which can be set at levels between 0.01 mbar and 1 bar. A pressure control unit 104 is used for this purpose. The pressure control unit 104 can be a vacuum pump with appropriate mechanisms for controlling gas transfer and avoiding back-diffusion towards the reactor 101.

Figure 6:
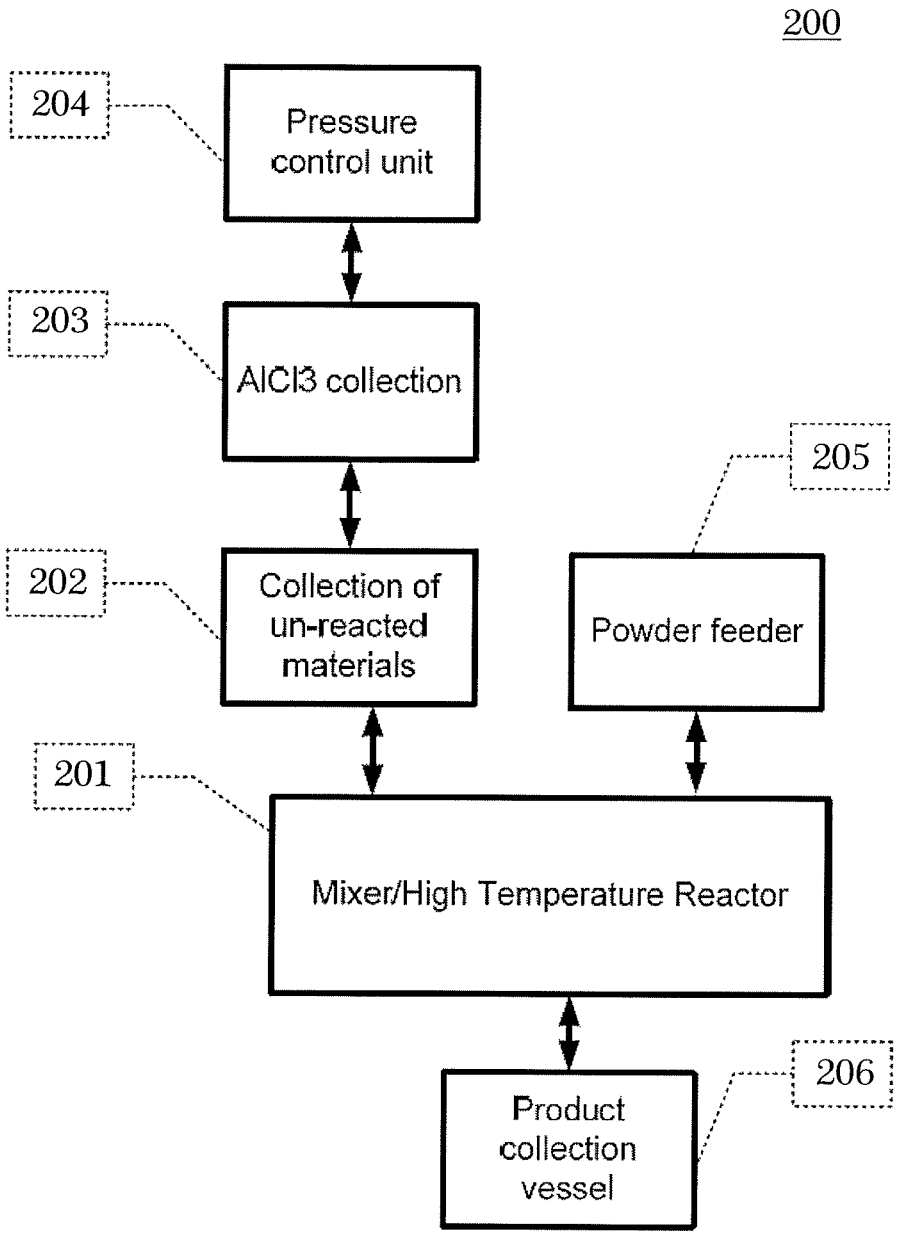
FIG. 6 is a block diagram of the configuration for an apparatus incorporating a continuous reactor for carrying out a process for producing Al—Sc based alloys according to an embodiment of the present invention.

Referring to the continuous mode configuration in FIG. 6, the apparatus 200 comprises one or more storage containers for holding the reactants and a powder feeder 205 for feeding reactants from at least one of the storage containers to the reactor vessel 201. The reactants are fed into one end of reactor vessel 201 and enter a reaction zone at a temperature T1 and processed through the reaction zone to a section at a maximum temperature T2 before they are moved towards a powder exit, preferably located at the opposite end of vessel 201. The powder products are then discharged into a dedicated storage vessel 206.

In one form, the continuous reactor vessel 201 is a rotary kiln wherein powder is transferred and mixed therein by the rotating action of the rotary vessel. In another form, the continuous reactor vessel 201 is a cylindrical tube with an auger or an Archimedes screw for mixing the reactants and moving them from the tube entrance to the powder exit at the opposite end.

As with the apparatus 100 configured for batch operation in FIG. 5, the continuous mode apparatus 200 incorporates a collector 202, a condenser 203 and a pressure control unit 204.

In both the batch and continuous reactors 101, 201, materials such un-reacted reducible reactants, semi processed solid reactants and/or metal alloy product can stick to and accrete on the reactor wall. Accordingly the reactor can include a dedicated mechanism for removing such accreted material off the wall such as a scraper. In embodiments where the reactor is in the form of an auger, screw or plough mixer, the auger, screw or plough itself may function to remove any accreted material from the walls of the reactor.

In all embodiments, the reactor comprises an exhaust for removing gases from the reactor.

Figure 7:
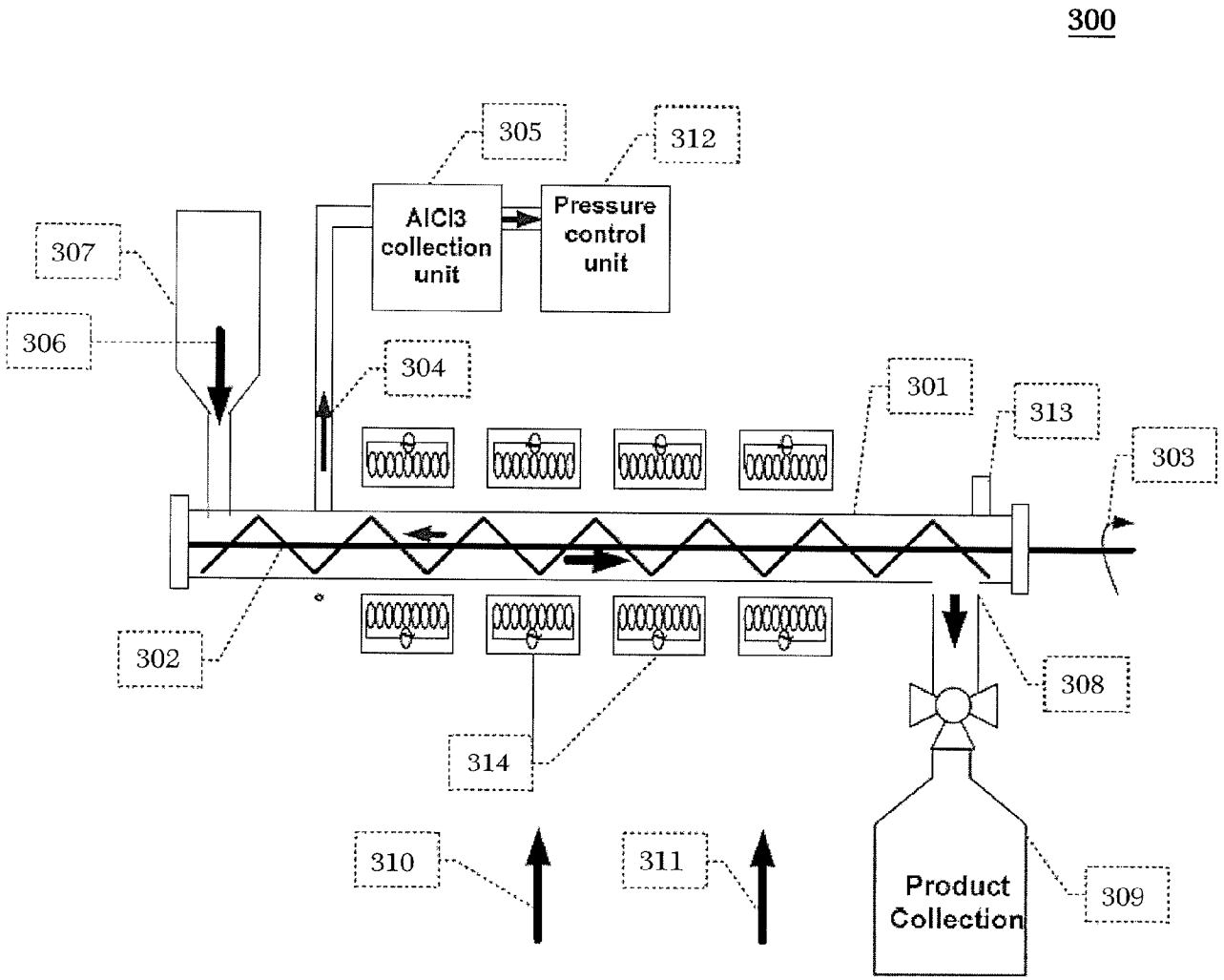
FIG. 7 is a schematic diagram of an apparatus comprising a continuous reactor in the form of a screw reactor for carrying out a process for producing Al—Sc based alloys according to an embodiment of the present invention.

Referring now to FIG. 7, an apparatus 300 for carrying out a process for producing Al—Sc based alloys according to an embodiment of the present invention is shown schematically.

The apparatus 300 comprises a main reactor vessel 301 in the form of a fixed tubular section with an auger 302 located therein. The auger is rotated externally by rotating means 303. The reactor vessel 301 is made of a special high temperature stainless steel grade suitable for processing corrosive materials. The apparatus 300 also comprises a particle feeder 306 for feeding reactants into the reactor 301 from one or more reactant storage containers 307.

The reactor 301 has a gas outlet 304 to allow for gaseous compounds to exit the reactor. The apparatus 300 also comprises a condenser 305 that is connected to the gas outlet 304 of the reactor 301 for stripping and collecting by-products, in particular aluminium chloride out of the gas stream that exits the reactor The reactor vessel 301 also includes a product outlet 308 at the opposite end of the vessel to where the reactants are fed into the vessel. A product collection vessel 309 is connected to the product outlet 308 to collect the Al—Sc based alloys produced in the reactor 301. A stream of inert gas is driven through the reactor 301 in a direction opposite to the movement of solids through the reactor. The inert gas is fed into the reactor 301 through gas inlet 313, which is near the product outlet 308. The flow of inert gas limits any diffusion of aluminium chloride towards the product collection vessel 309.

The reactor 301 and its gas outlet 304 leading to the condenser 305 and any internal walls located within those parts of the apparatus are kept a temperature higher than the boiling temperature(s) or the sublimation temperature(s) of aluminium chloride; preferably above 160° C. and more preferably above 200° C.

The reactor 301 is operated at a minimum temperature of around 200° C. where the solid reactants are introduced into the reactor by the particle feeder 306. The temperature increases to a first temperature T1 within the reactor in a first section around position 310 and then increasing again to a maximum temperature T2 in a second section around position 311 before decreasing to around room temperature at the product outlet 308. T1 depends on a combination of factors, including the pressure within the vessel and the kinetic barrier for reaction between the scandium chloride and any other alloying additives that are being fed to the reactor 301 and the Al reductant. Preferably, T1 is below the melting temperature of Al. T2 is preferably below 1000° C. The relative positions of T1 and T2 and the speed of powder movement within the reactor determine the residence times of materials at various temperatures and are themselves determined in accordance with the reaction requirements.

A pressure control unit 312 in the form of a vacuum pump is connected to reactor 301 through the condenser 305 and the reactor's gas outlet 304. The pressure control unit 312 controls and reduces the pressure in the reactor to between 0.01 mbar and 1 bar by drawing gas out of the reactor through the gas outlet 304. The pressure control unit 312 is provided with a throttle valve and a trap to limit any back diffusion of oil and air towards the reactor vessel 301.

In operation, the reducible reactants including $ScCl_3$ and the reducing Al alloy stored together in container 307 are fed into the reactor vessel 301 where they are mixed in-situ and heated at temperatures between 200° C. and 1000° C. in a reaction zone within the reactor 301. As the materials proceed through the reactor they react, leading to formation of metallic Al—Sc compounds and aluminium chloride. The gas that is injected into the reactor through the gas inlet 313 flows through the reactor in a direction opposite to the movement of the solids through the reactor. This gas flow dilutes and drives the $AlCl_3$ by-products away from the reaction zone and out of the reactor 301 through gas outlet 304 and into the condenser 305 where they are stripped out of the gas stream at a temperature lower than 200° C. Although FIG. 7 shows the reactor 301 only having a single gas inlet 313, in other embodiments, the reactor may be provided with multiple gas inlets spaced along the length of the reactor.

The flow of gas to the gas outlet 304 may be assisted by the pressure control unit 312 which applies a reduced pressure at the gas outlet 304. In some embodiments, the movement of the gaseous byproducts away from the reaction zone in a direction opposite to the solid movement through the reactor is induced solely by the low pressure applied by the pressure control unit 312 and without the injection of a gas flow through gas inlet 313.

As the reducible reactant materials and the reducing Al move through the reactor they are mixed continuously by the rotating action of the auger 302. The residence time of the materials at various temperatures in the reactor affects the degree of agglomeration/sintering of the end product and the process may involve varying the residence time to obtain a desired particle size distribution. The residence time of the reactants through the various heating zones is determined by a combination of factors, including the positions of T1, T2 and the rotation speed of the auger. The apparatus 300 is provided with a heating/cooling arrangement 314 to control the heat flow within the reactor 301 and maintain the required temperature profile.

Un-reacted materials reaching the highest temperature section within the reactor during processing can be blown out toward the solid inlet end of the reactor by the high velocity byproduct gas emanating from the reacting materials or the gas entering through the gas inlet 313 where they are cooled and mixed with a fresh feed of solid material progressing through the reactor in the direction of the high temperature zone.

EXAMPLES

The following are examples of processes for the preparation of Al—Sc based alloys.

Figure 8:
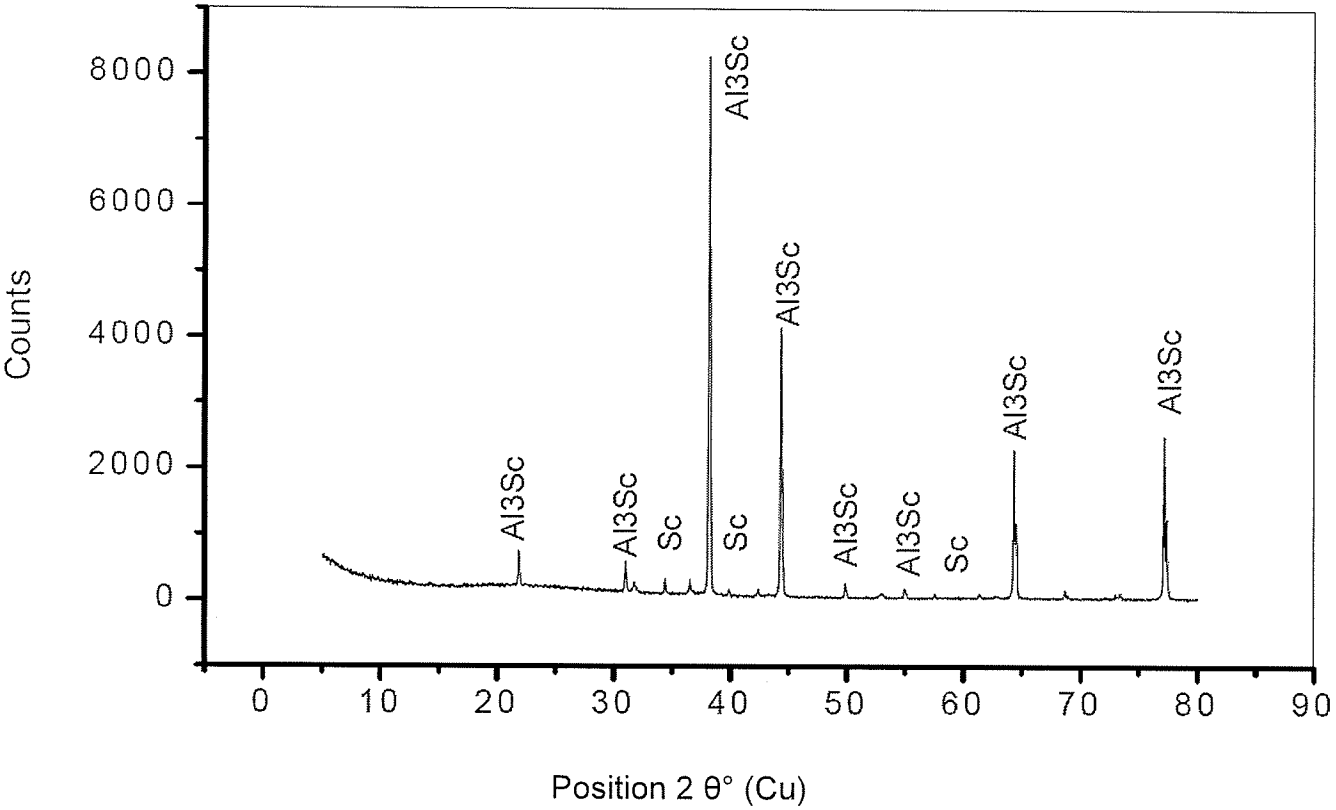
FIG. 8 is an XRD trace of a powder produced by a process according to an embodiment of the present invention, with a solid reactant feed $ScCl_3$—Al at a molar ratio of 1:4 and under a reaction condition pressure of 2 mbar.

Example 1: Production of $Al_3Sc$ Powder 5 g of Al powder with a mean particle size of less than 15 microns is mixed with $ScCl_3$ powder at a molar ratio of 4Al to $1ScCl_3$. The materials are then placed inside a quartz tube and heated at temperatures between 600° C. and 900° C. at a pressure less than 100 mbar. The temperature is first held at 600° C. for 10 minutes, then increased to 650° C. for 10 minutes and to 700° C. for 10 minutes and then to 800° C. for 10 minutes and 900° C. for 10 minutes. The materials are then discharged and analysed. The product is a powder made of $Al_3Sc$ with a small amount of Sc. FIG. 8 shows an XRD spectrum of the materials, clearly indicating the dominance of lines corresponding to $Al_3Sc$.

Example 2: Production of $Al_3Sc$ Powder 5 g of Al powder with a mean particle size of less than 15 microns are mixed with $ScCl_3$ powder at a mole ratio of 4Al to $1ScCl_3$. The materials are then placed inside a quartz tube and heated at temperatures between room temperature and 900° C. at a pressure less than 10 mbar. The temperature is increased by steps of 100° C. with a total heating time of 60 minutes. The materials are then discharged and analysed. The product is a powder made of $Al_3Sc$.

Example 3: Production of $Al_3$(Sc—Zr Powder)

5 g of Al powder with a mean particle size of less than 15 microns are mixed with $ScCl_3$ powder and $ZrCl_4$ powder at a mole ratio of 4Al to 0.5 $ScCl_3$ and 0.5 $ZrCl_4$. The materials are then placed inside a quartz tube and heated at temperatures between room temperature and 900° C. at a pressure less than 10 mbar. The temperature is increased by steps of 100° C. with a total heating time of 60 minutes. The materials are then discharged and analysed. The product is a powder made of $Al_3$(Sc—Zr).

Example 4: Production of $Al_3$(Sc—Zr) Powder 5 g of Al—Zr powder with a mean particle size of less than 15 microns are mixed with $ScCl_3$ powder at a mole ratio of 7Al to $1ScCl_3$ and with a Al:Zr composition equivalent to a ratio of 7:1. The materials are then placed inside a quartz tube and heated at temperatures between room temperature and 900° C. at a pressure less than 10 mbar. The temperature is gradually increased to 900° C. over a period of 60 minutes. The materials are then discharged and analysed. The product is a powder mostly made of $Al_3$(Sc—Zr).

Example 5: Production of $Al_3Sc$—B powder 5 g of Al powder with a mean particle size of less than 15 microns are mixed with 0.1 g of Boron powder and a $ScCl_3$ powder at a mole ratio of 3Al to 1 $ScCl_3$. The materials are then placed inside a quartz tube and heated at temperatures between room temperature and 900° C. at a pressure less than 10 mbar. The temperature is gradually increased to 900° C. over a period of 60 minutes. The materials are then discharged and analysed. The product is a powder mostly made of $Al_3Sc$—B.

Example 6: Production of $Al_3Sc$—Cu powder 5 g of Al—Cu powder with a mean particle size of less than 15 microns (Al:Cu atomic ratio is 10 to 1) are mixed with $ScCl_3$ powder at a mole ratio of 3Al to 1 $ScCl_3$. The materials are then placed inside a quartz tube and heated at temperatures between room temperature and 900° C. at a pressure less than 10 mbar. The temperature is increased by steps of 100° C. with a total heating time of 60 minutes. The materials are then discharged and analysed. The product is a powder mostly made of Al—Sc—Cu.

The process according to the present invention may be used for production of alloys or compounds based on Al—Sc from starting compounds of scandium chlorides and aluminium. The process may also involve alloying additives including pure metal, alloys, intermetallics, and oxides, nitrides and halides of any non inert element(s) from the periodic table. Modifications, variations, products and use of said products as would be apparent to a skilled addressee are deemed to be within the scope of the present invention.

In the claims which follow and in the preceding description of embodiments, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be understood to persons skilled in the art of the disclosure that many modifications may be made without departing from the spirit and scope of the invention.

It is to be understood that any acknowledgement of prior art is not to be taken as an admission that this prior art forms part of the common general knowledge in Australia or elsewhere.

The invention claimed is:

1. A process for producing an aluminium-scandium based alloy from aluminium and scandium chloride, and including the step of reducing scandium chloride particulates in the presence of aluminium particulates through direct solid-solid reactions in a reaction zone and under reaction conditions which favour production of the aluminium-scandium based alloy, thereby producing aluminium-scandium based alloy particulates, and aluminium chloride as a by-product.

2. A process as claimed in claim 1, wherein the reaction conditions comprise maintaining a reduced partial pressure for aluminium chloride in the reaction zone.

3. A process as claimed in claim 1, wherein the reaction conditions comprise a partial pressure of aluminium chloride of less than 500 mbar.

4. A process as claimed in claim 1, wherein the reaction conditions comprise removal of at least some of the aluminium chloride from the reaction zone as it is produced.

5. A process as claimed in claim 1, wherein the reaction conditions comprise diluting the aluminium chloride in the reaction zone.

6. A process as claimed in claim 1, wherein the reaction conditions comprise a minimum temperature of 160° C.

7. A process as claimed in claim 1, wherein the reaction conditions comprise at least a section of the reaction zone having a temperature of at least 600° C.

8. A process as claimed in claim 1, wherein the reaction conditions comprise a maximum temperature of between 600° C. and 1000° C.

9. A process as claimed in claim 1, wherein the reaction zone has a first section in which the reaction conditions comprise a temperature of 600 to 900° C. and a second section in which the reaction conditions comprise a temperature of 600 to 1000° C. and wherein the second section is at a higher temperature than the first section.

10. A process as claimed in claim 1, wherein the scandium chloride particulates and the aluminium particulates are provided to the reaction zone as solid particles.

11. A process as claimed in claim 1, wherein the scandium chloride particulates and the aluminium particulates are provided with a mean particle size in one dimension of less than 50 micron.

12. A process as claimed in claim 1, wherein the process comprises milling the scandium chloride particulates and/or aluminium particulates to a particle size in one dimension of less than 50 micron.

13. A process as claimed in claim 12, wherein the scandium chloride particulates and/or the aluminium particulates are milled in the presence of aluminium chloride.

14. A process as claimed in claim 1, wherein the process comprises preparing a mixture of scandium chloride particulates and aluminium particulates, prior to feeding the mixture to the reaction zone.

15. A process as claimed in claim 1, wherein process comprises moving solids through the reaction zone in a first direction and moving gases through the reaction zone in a second direction.

16. A process as claimed in claim 1, wherein the process further comprises adding additional elements to the reaction zone.

17. A process as claimed in claim 16, wherein one or more of the other alloying elements comprising any one or more of zirconium, silicon, boron, or copper are provided to the reaction zone as an alloy with the aluminium and/or as part of a compound with the aluminium.

18. A process as claimed in claim 16, wherein the process comprises reacting and/or alloying the aluminium with one or more of the other alloying elements prior to mixing it with the scandium chloride.

19. A process as claimed in claim 1, wherein the reaction zone is located in a reactor, the reactor having a reactant inlet, a product outlet and a gas outlet, the process comprising feeding the scandium-chloride particulates and aluminium particulates to the reactor through the reactant inlet and outputting the aluminium-scandium based alloy from the reactor through the product outlet.

20. A process as claimed in claim 19, wherein the reaction conditions comprise a pressure gradient across the reactor from a first end of the reactor to a second end of the reactor, the reactant inlet and the gas outlet located towards the first end and the product outlet located towards the second end, and wherein the pressure in the reactor at the first end is lower than at the second end.

21. A process as claimed in claim 19, wherein the reaction conditions comprise a temperature gradient across the reactor from a first end of the reactor to a second end of the reactor, the reactant inlet and the gas outlet located towards the first end and the product outlet located towards the second end, and wherein the temperature in the reactor at the first end is lower than at the second end.

22. A process as claimed in claim 19, wherein the process further comprises:

flowing an inert gas through the reaction zone in a direction opposite to the scandium chloride particulates and aluminium particulates;

mixing the scandium chloride particulates and aluminium particulates as they move through the reactor; and collecting any particulates that exit the reaction zone with the inert gas and returning the collected particulates solids to the reaction zone.

* * * * *